United States Patent [19]

Colavito et al.

[11] Patent Number: 4,715,621

[45] Date of Patent: Dec. 29, 1987

[54] NUMERIC COLOR CODED FILING SYSTEM

[76] Inventors: William Colavito, R.D. 2, Box 450, Woodbine, N.J. 08270; Christa Riggins, 242 E. Ridgewood Ave., Absecon, N.J. 08201

[21] Appl. No.: 872,547

[22] Filed: Jun. 10, 1986

[51] Int. Cl.[4] ..... B42F 21/04; B42F 21/12

[52] U.S. Cl. ..... 283/36; 40/359

[58] Field of Search ..... 156/216, 249, 299; 40/5, 23 A, 359, 360; 283/1 R, 81, 36, 37, 38, 39, 40, 41, 42, 43

[56] References Cited

U.S. PATENT DOCUMENTS

| | | | |
|---|---|---|---|
| 1,067,531 | 7/1913 | MacGregor | 40/23 A |
| 3,473,827 | 10/1969 | Leadbetter | 283/36 |
| 3,962,807 | 6/1976 | Pantone | 40/359 X |
| 4,175,777 | 11/1979 | Horn | 40/359 X |
| 4,329,191 | 5/1982 | Barber | 283/81 X |
| 4,580,815 | 4/1986 | Barber | 283/81 |
| 4,585,253 | 4/1986 | Beiswanger | 283/36 X |

FOREIGN PATENT DOCUMENTS

| | | | |
|---|---|---|---|
| 974841 | 9/1975 | Canada | 40/359 |
| 2337630 | 8/1977 | France | 40/359 |

*Primary Examiner*—Paul A. Bell

*Attorney, Agent, or Firm*—Norman E. Lehrer

[57] ABSTRACT

A numeric color coded filing system for expandable files includes a base member having an adhesive back which is applied to the face of a file along its right side with the right vertical edge of the base member extending outwardly past the edge of the file. The height of the base member is preferably equal to the height of the file and the vertical right edge is folded over onto itself about a vertical line. A plurality of colored labels are provided to be affixed to the edge of the base member. Each label has a pair of identical digits 0–9 printed thereon with a different color being associated with each digit. The labels include an adhesive on the reverse side and are secured to the vertical edge of the base member with one digit of each label being visible from the front of the file and the other being visible from the rear thereof.

6 Claims, 7 Drawing Figures

NUMERIC COLOR CODED FILING SYSTEM

BACKGROUND OF THE INVENTION

The present invention is directed toward a numeric color coded filing system and more particularly toward such a system for use with expandable files.

As is well known in the art, expandable files are frequently used in law offices and other business offices for holding a plurality of file folders and other types of papers and documents. It is very common for these files to be labeled by simply handwriting the relevant file number and name and other information directly on the face of the file using a marking pencil or the like. This creates several problems. The most difficult of which is in locating a file which has been placed on a storage shelf. Expandable files are normally stored on shelves resembling bookshelves with only an end exposed. The file information written on the face of the file is totally covered by the next adjacent file.

Another less aggravating but no less important problem created by such use of expandable files is their cost. When the file information is written directly on the face of the file, the file cannot be reused for some other matter. Since the files are relatively expensive, it would be highly desirable to be able to reuse expandable file folders from matters which have been totally closed.

One proposed solution to part of the above-described problems is a product which has recently come onto the market called COLOR-BANDS which are available from Authentex, Incorporated of Solon, Ohio. COLOR-BANDS are colored strips of a strong sheet-like material having an adhesive on the back side thereof. The strips are approximately 10 inches long by 2 inches high and are secured to the ends of an expandable file by securing approximately 2 inches of each end of the strip to the front and back of the file whereby the strip extends across the gusset of the file. The COLOR-BANDS strip functions as a handle and file identification information such as a file number can be printed on a white block located in the middle of the strip.

Although the COLOR-BANDS may help to identify files from the exposed ends thereof, they are of somewhat limited value since the amount of information written on the COLOR-BANDS is rather limited due to the space available. Thus, more complete information must be written on the face of the file. As a result, the expandable files cannot be reused.

The COLOR-BANDS are also incapable of solving another very aggravating problem which one experiences when using expandable files and that is the locating of a file which has been misfiled on a shelf. Since the COLOR-BANDS are produced in several different colors, categories of files could, perhaps, be identified by a particular color. If this were done, a gross error in the location of a file might be discoverable but if a file is merely placed in the wrong numerical sequence, it would be extremely difficult to locate.

To Applicants' knowledge, no one has ever proposed a filing system which is particularly useful for expandable file folders and which has the ability to assist a clerk in immediately locating a misfiled folder. U.S. Pat. No. 4,544,182 does disclose a color coded labeling system but this system is specifically designed for end-tab filing and cannot be used with expandable files.

SUMMARY OF THE INVENTION

The present invention is directed toward a numeric color coded filing system which is particularly adaptable for use with expandable files. When properly used, the system quickly identifies a file and immediately can advise a clerk when a file has been misfiled. Even further, the system allows for the reuse of expandable files. The system of the invention includes a base member having an adhesive back which is applied to the face of a file along its right side with the right vertical edge of the base member extending outwardly past the edge of the file. The height of the base member is preferably equal to the height of the file and the vertical right edge is folded over onto itself about a vertical line. A plurality of colored labels are provided to be affixed to the edge of the base member. Each label has a pair of identical digits 0–9 printed thereon with a different color being associated with each digit. The labels include an adhesive on the reverse side and are secured to the vertical edge of the base member with one digit of each label being visible from the front of the file and the other being visible from the rear thereof.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
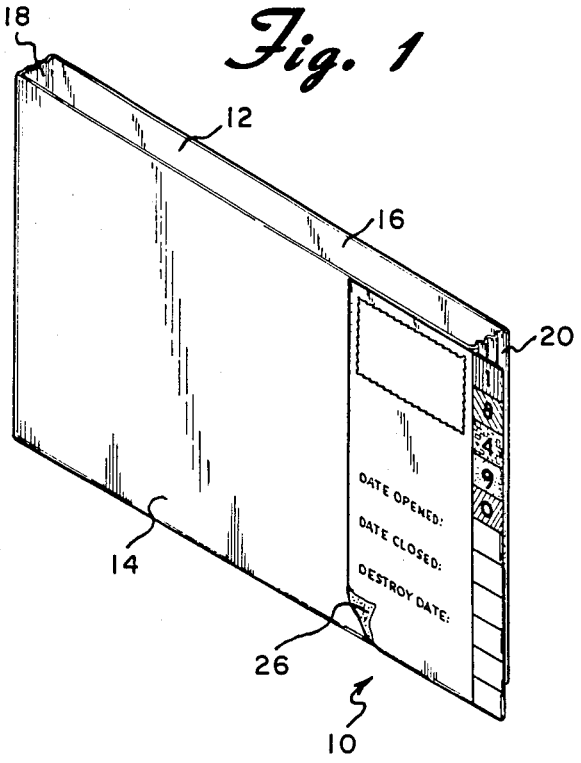
FIG. 1 is a front perspective view of an expandable file utilizing the numeric color coded filing system of the present invention.

Referring now to the drawings in detail wherein like reference numerals have been used throughout the various figures to designate like elements, there is shown in FIG. 1 a numeric color coded filing system constructed in accordance with the principles of the present invention and designated generally as 10. The filing system 10 is shown applied to a standard expandable file 12. File 12 is a standard expandable file having a front wall 14, a rear wall 16 and left and right side walls 18 and 20 comprised of expandable gussets. The bottom wall (not shown) is also comprised of an expandable gusset as is well known in the art.

Figure 3:
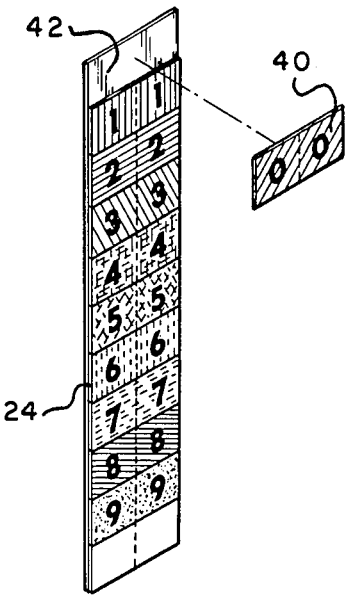
FIG. 3 is a perspective view of the numeric color coded labels utilized with the invention.

The numeric color coded filing system 10 is comprised essentially of two components: a substantially rectangularly shaped base member 22 (FIG. 2) and a plurality of color coded numeric labels 24 (FIG. 3). The base member 22 is comprised of a substantially flexible sheet-like material which may be paper but is preferably made of Tyvek which is a spunbounded olefin fiber material produced by DuPont. The entire reverse side of the base member 22 has a pressure-sensitive adhesive thereon such as shown at 26 in FIG. 1. Prior to being used, the base member 22 has a sheet of release paper covering the adhesive 26 so as to protect the adhesive and to prevent it from adhering to other materials as is well known in the label art.

The base member 22 has a height which is substantially equal to the height of the front wall or face 14 of the file 12. As will become clearer hereinafter, this is desirable so that when a plurality of files are labeled in accordance with the present invention, the labels on all of the files in a row will be in proper alignment with each other. However, this could also be accomplished by merely insuring that when the base members 22 are applied to the files, the bottom of the base member 22 is made to coincide exactly with the bottom of the face 14 of the file. This will guarantee alignment of adjacent labels even if the heights of the files may differ.

The overall width of the base member 22 is not critical. It is preferred, however, that it be less than the width of the face 14 so that it can be easily applied thereto when desired. The base member 22 is divided into a plurality of sections. The largest section 28 may have some preprinted material thereon concerning the contents of the file such as shown at 30 and includes sufficient blank space so that other visually perceivable indicia concerning the file such as the case name can be written thereon. The face of the base member 22 adjacent the right vertical edge thereof is divided into a plurality of substantially equal parts such as part 32 shown in FIG. 2. These parts are created by a plurality of equally spaced parallel horizontal lines 34. In the preferred embodiment, there are 11 such parts 32 and each is approximately 2 inches wide and slightly less than 1 inch high. A vertical fold line 36 is also formed on the base member 22 substantially in the middle of each of the parts 32. Vertical line 38 separates the plurality of parts 32 from the portion 28 of the base member 22.

The plurality of numeric color coded labels are shown at 24 in FIG. 3. Each label such as label 40 having the digit 0 thereon is comprised of a sheet-like material which is preferably also Tyvek and also has a pressure-sensitive adhesive on the reverse side thereof. The labels are carried on a sheet of release paper or the like 42 until they are desired to be used.

As shown in FIG. 3, each label is substantially equal in size to each of the parts 32 of the base member 22. Each label also includes a pair of horizontally spaced identical digits thereon. In the preferred embodiment, the ten digits 0–9 are utilized. It may also be possible, however, to use other indicia such as symbols or letters in addition to the digits. The background of each label 40 is colored with a different background color being uniquely associated with each digit. For example, in the preferred embodiment, the digit 0 may have a brown background, the digit 1 red, the digit 2 blue, 3 green, 4 yellow, etc.

Figure 2:
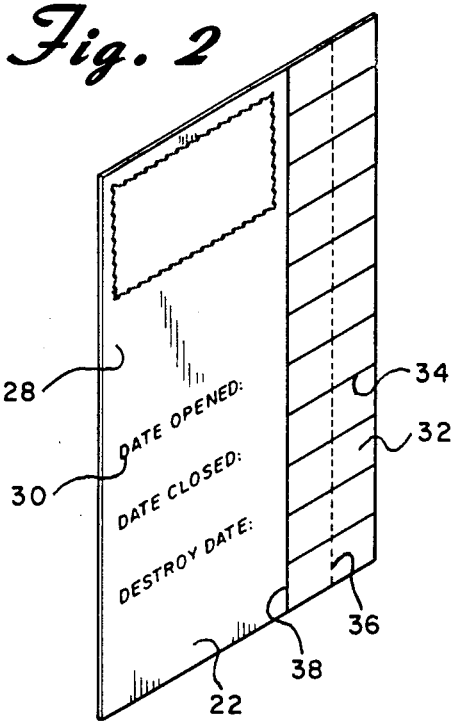
FIG. 2 is a front perspective view of a base member which forms a part of the invention.
Figure 4:
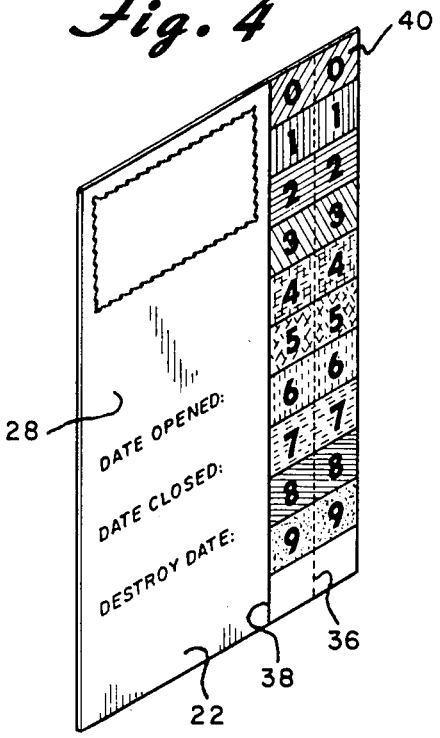
FIG. 4 is a perspective view of the base member shown in FIG. 2 with labels attached thereto.

While FIGS. 2 and 3 show that the base member 22 and the plurality of labels 24 can be provided as two separate entities, it is also possible to apply the individual labels directly to the base member 22 to be sold as a set as shown in FIG. 4. If the base member 22 and labels 40 are comprised of the proper materials, the labels will adequately stick to the base member but can be removed and rearranged when desired. Thus, with the embodiment shown in FIG. 4, the labels with the undesired digits can be removed and discarded and the desired digits can be moved into their proper positions as will be explained more fully hereinafter. Furthermore, although FIGS. 3 and 4 show the plurality of label bearing digits 0–9, it would also be possible to provide a plurality of labels carrying only digits 0, a plurality of labels carrying only digits 1, etc.

The numeric color coded filing system of the invention is utilized in the following manner. The release paper from the reverse side of a base member 22 is removed and the base member is then affixed to the front face 14 of a file 12 adjacent the right side thereof. The base member 22 is attached to the file 12 with the vertical line 38 in alignment with the extreme right edge of the face 14. As a result, the right vertical edge of the base member 22 extends outwardly beyond the face of the file 14. The outwardly extending edge of the base member 22 carrying the parts 32 is then folded over the vertical fold line 36 and pressed against itself. Because the extending vertical edge of the base member 22 now has a double thickness and because it is relatively narrow, it tends to remain substantially vertical even though it is made of a relatively flexible material.

The correct digits needed to identify the contents of the file 12 are then selected and, one at a time, they are removed from their release sheet 42 and applied to the proper part 32 on the vertical edge of the base member 22. As shown in FIG. 1, the digits 1-8-4-9-0 are applied in that order from the top of the base member 22 to identify the file as file number 18,490. The labels are applied by simply pressing the left-hand digit onto the front of the base member 22 and then folding the label around to the back so that the right-hand digit adheres to the reverse side of the vertical edge of the base member 22. In this way, the identical digits are visible from both the front of the file and the rear thereof and are in proper alignment on both the front and rear. While the labels with the digits thereon have been shown as being applied beginning with the first part or space at the top right of the base member 22, it is also possible to start the digits one or more spaces down and to utilize the upper space to carry a label having only a color thereon and no other indicia or some indicia other than a number to identify a category of file. For example, in a law office, all criminal files could have a black label in the first space and a white label could be used to identify all civil matters. The color coded numerical digits could then begin below the black or white label.

Figure 5:
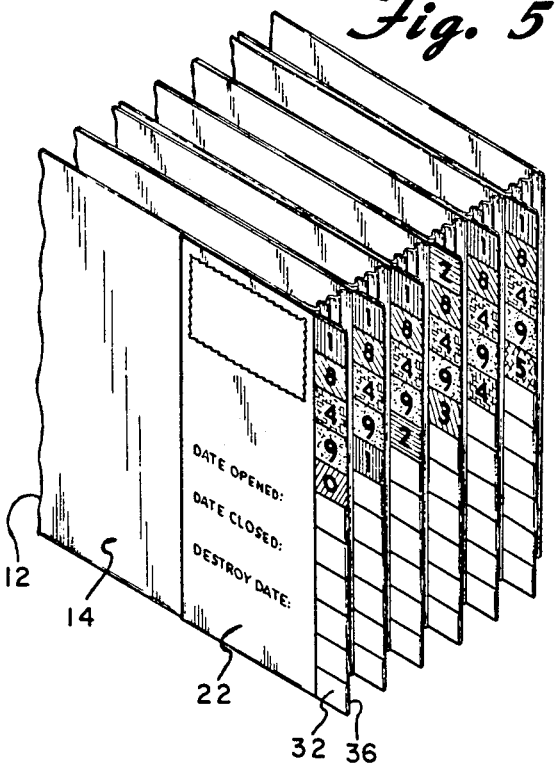
FIG. 5 is a front top perspective view of a plurality of expandable files utilizing the invention.
Figure 6:
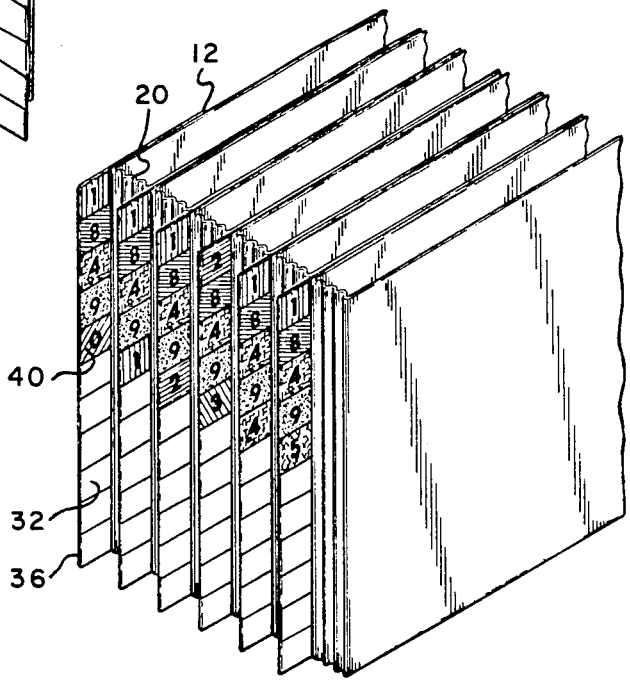
FIG. 6 is a rear top perspective view of the files shown in FIG. 5.

FIGS. 5 and 6 show the numeric color coded filing system of the present invention as applied to a plurality of expandable files which are then stored on a shelf or rack with the right edges, as viewed in FIG. 5, extending outwardly. Six such files are shown in FIGS. 5 and 6 which are intended to be consecutively numbered 18,490 to 18,495. As shown in FIGS. 5 and 6, the numbers are clearly visible when viewing the series of files from either the front or the back thereof.

Figure 7:
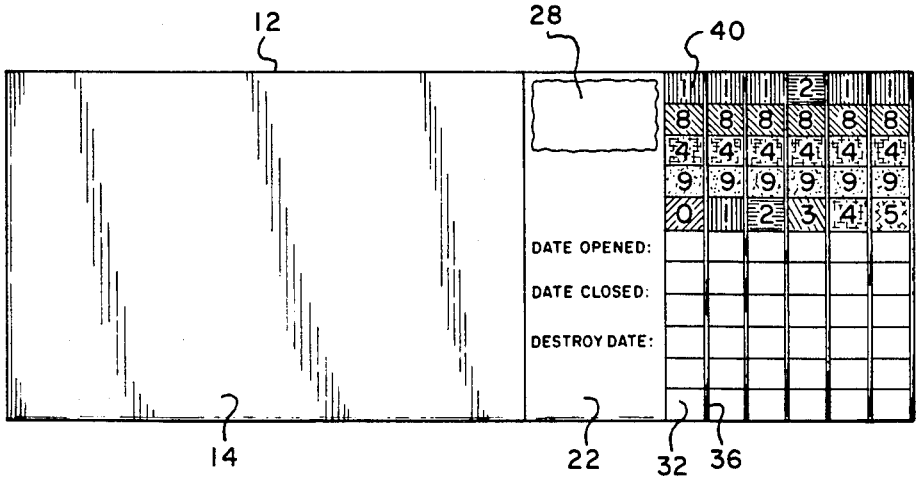
FIG. 7 is a front side perspective view of the files shown in FIGS. 5 and 6.

FIG. 7 illustrates how the numeric color coded filing system of the present invention can quickly locate a misfiled file and can immediately advise a clerk when a file is out of order. FIG. 7 is a view of the plurality of files shown in FIG. 5 but looking substantially straight back from the right side of the files. This is easily accomplished by the clerk merely standing at eye level to the labels and looking straight back in a row. If all of the files have been properly filed, all of the first labels in the row (or at least a major portion of the row) should be of the same color. Similarly, all of the second labels should be of the same color. Only the labels at the bottom should be of different colors and these should form a perceptible pattern. Thus, even if the clerk cannot read all of the numbers throughout the entire row, the colors will be visible. In the example shown in FIG. 7, it will be immediately noticed that the fourth file back is out of order since the top label is blue while the other top labels in the remaining files in the row are red. File number 28,493 is, therefore, in the wrong location.

The present invention may be embodied in other specific forms without departing from the spirit or essential attributes thereof and accordingly reference should be made to the appended claims rather than to the foregoing specification as indicating the scope of the invention.

We claim:

1. A numeric color coded filing system for use with expandable files of known height and width comprising:

a substantially rectangularly shaped base member, said base member having a height which is substantially equal to the height of the face of the expandable files with which it is to be used and having a width which is less than the front length of said file but large enough to carry visually perceivable written indicia thereon, said base member being comprised of a substantially flexible sheet-like material and having an adhesive on the reverse side thereof;

the face of said base member along one vertical edge thereof having means dividing the same into a plurality of vertically arranged and substantially equal parts; when said base member is affixed to the front face of a file, said vertical edge is adapted to extend outwardly beyond the face of said file and to remain substantially vertical, the width of said vertical edge being substantially smaller than the width of the remaining portion of said base member;

said remaining portion of said base member having a surface which is adapted to be written upon and including a plurality of predesignated areas for the entry of data, some of said predesignated areas having preprinted indicia thereon and others of said areas being adapted to carry user entered indicia;

a plurality of labels, each of said labels being comprised of a sheet-like material and being substantially equal in size to each of said plurality of parts, each label having a numeric digit thereon and having a background color uniquely associated with said digit, each of the ten digits 0–9 being associated with a different background color, said labels having an adhesive on their reverse sides and being adapted to be affixed to said base member along said vertical edge.

2. The invention as claimed in claim 1 wherein each of said labels carries a pair of horizontally spaced identical digits, each said label being adapted to be folded over around a vertical center line so that the same can be affixed to both the front and reverse sides of said base member along said vertical edge whereby said digits and said colored backgrounds are visible from both the front and rear of said files.

3. The invention as claimed in claim 2 wherein the width of said vertical edge of said base member is substantially twice the width of one of said digits and its associated background whereby said vertical edge can be folded over onto itself along a vertical line.

4. The invention as claimed in claim 1 wherein said base member is comprised of paper.

5. The invention as claimed in claim 1 wherein said base member is comprised of spunbounded olefin fiber material.

6. The invention as claimed in claim 1 wherein said adhesive on said base member is a pressure-sensitive adhesive and further including a release sheet covering said pressure-sensitive adhesive before its use.

* * * * *